US007677387B2

(12) United States Patent
Brand et al.

(10) Patent No.: US 7,677,387 B2
(45) Date of Patent: Mar. 16, 2010

(54) CARRIER FOR CONTAINERS

(75) Inventors: Kirsten Laura Brand, Marietta, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 95 days.

(21) Appl. No.: 11/767,786

(22) Filed: Jun. 25, 2007

(65) Prior Publication Data

US 2007/0295623 A1 Dec. 27, 2007

Related U.S. Application Data

(60) Provisional application No. 60/816,105, filed on Jun. 23, 2006.

(51) Int. Cl.
*B65D 71/00* (2006.01)
*B65D 71/12* (2006.01)
*B65D 75/00* (2006.01)

(52) U.S. Cl. ..... 206/168; 206/162; 206/170; 206/175; 206/180; 206/194

(58) Field of Classification Search ..... 206/162, 206/168, 169, 175, 180, 191, 194, 196–199, 206/167, 170, 174, 181, 193
See application file for complete search history.

(56) References Cited

U.S. PATENT DOCUMENTS 2,225,822 A 12/1940 Crook
2,227,330 A * 12/1940 Turner ..... 206/168
2,331,312 A * 10/1943 Dorfman ..... 206/168
2,336,857 A * 12/1943 Gies et al. ..... 206/198
2,689,061 A 9/1954 Gray
2,783,916 A * 3/1957 Hodapp ..... 206/167
3,053,411 A 9/1962 Struble et al.
3,190,487 A 6/1965 Wood
3,191,800 A 6/1965 Kowal
3,236,414 A 2/1966 Slevin, Jr.
3,669,306 A * 6/1972 Forrer ..... 206/188
3,917,061 A 11/1975 Stout
4,171,046 A 10/1979 Bonczynk
4,205,748 A 6/1980 Wilson
4,243,138 A 1/1981 Wilson
4,362,240 A 12/1982 Elward
4,450,956 A 5/1984 Wood
4,792,038 A * 12/1988 Cooper ..... 206/180
5,040,672 A 8/1991 DeMaio et al.
5,458,234 A 10/1995 Harris (Continued)

FOREIGN PATENT DOCUMENTS

DE 9004439 U1 6/1990

*Primary Examiner*—Mickey Yu
*Assistant Examiner*—Sharon M Prange
(74) *Attorney, Agent, or Firm*—Womble Carlyle Sandridge & Rice, PLLC

(57) ABSTRACT

A carrier for holding a plurality of containers. The carrier has panels that extend at least partially around an interior of the carrier. The panels comprise at least one bottom panel, a front panel, a back panel, and at least two side panels. A divider flap is foldably attached to the back panel and the front panel. The side panels, the back panel, the divider flap, and the front panel are arranged to at least partially define at least two container-receiving spaces of the interior.

32 Claims, 6 Drawing Sheets

U.S. PATENT DOCUMENTS 5,499,712 A 3/1996 Harrelson
5,531,319 A 7/1996 Harrelson
5,538,130 A 7/1996 Harrelson
5,538,131 A 7/1996 Harrelson
5,590,762 A 1/1997 Harrelson
5,593,027 A 1/1997 Sutherland
5,649,620 A 7/1997 Harrelson
5,657,864 A 8/1997 Harrelson
5,657,865 A 8/1997 Harrelson
5,682,982 A * 11/1997 Stonehouse ..... 206/142
5,775,487 A 7/1998 Harrelson
5,878,877 A 3/1999 Sutherland
5,947,273 A 9/1999 Dalrymple et al.
6,131,729 A 10/2000 Eckermann et al.
6,155,962 A 12/2000 Dalrymple et al.
6,341,689 B1 1/2002 Jones
6,371,287 B1 4/2002 Jones et al.
6,736,260 B2 5/2004 Gomes et al.
6,938,756 B2 9/2005 Schuster
2005/0230273 A1 10/2005 Kohler

* cited by examiner

CARRIER FOR CONTAINERS

CROSS-REFERENCE TO RELATED APPLICATION

This application claims the benefit of U.S. Provisional Application No. 60/816,105, which was filed on Jun. 23, 2006. The entire content of the above-referenced provisional application is hereby incorporated by reference as if presented herein in its entirety.

BACKGROUND OF THE INVENTION

The present invention generally relates to carriers or cartons for holding and displaying containers. More specifically, the present invention relates to basket-style carriers.

SUMMARY OF THE INVENTION

In general, one aspect of the invention is directed to a carrier for holding a plurality of containers. The carrier comprises panels that extend at least partially around an interior of the carrier. The panels comprise at least one bottom panel, a front panel, a back panel, and at least two side panels. A divider flap is foldably attached to the back panel and the front panel. The side panels, the back panel, the divider flap, and the front panel are arranged to at least partially define at least two container-receiving spaces of the interior. A retention panel is pivotable relative to the back panel for retaining a least one container of the plurality of containers.

In another aspect, the invention is generally directed to a blank for forming a carrier for holding a plurality of containers. The blank comprises panels that comprise at least one bottom panel, a front panel, a back panel, at least two side panels, a handle panel, and a retention panel foldably attached to the handle panel. A divider flap is foldably attached to the back panel and the front panel. The retention panel has at least two apertures.

In another aspect, the invention is generally directed to a method of forming a carrier for containing a plurality of containers. The method comprises providing a blank having panels that comprise a front panel, a back panel, at least two side panels, a handle panel, and a retention panel foldably connected to the handle panel. A divider flap is foldably attached to the back panel and the front panel. The retention panel has at least one aperture for respectively receiving a portion of a container of the plurality of the containers. The method further comprising pivoting the divider flap relative to the back panel to at least partially define at least two container-receiving openings.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present invention generally relates to carriers, packages, constructs, sleeves, cartons, or the like, for holding and displaying containers such as jars, bottles, cans, etc.

The containers can be used for packaging food and beverage products, for example.

The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present invention can accommodate containers of numerous different shapes. For the purpose of illustration and not for the purpose of limiting the scope of the invention, the following detailed description describes beverage containers (e.g., plastic containers) at least partially disposed within the carrier embodiments. In this specification, the terms "lower," "bottom," "upper", "top", "front", and "back" indicate orientations determined in relation to fully erected carriers.

Figure 1:
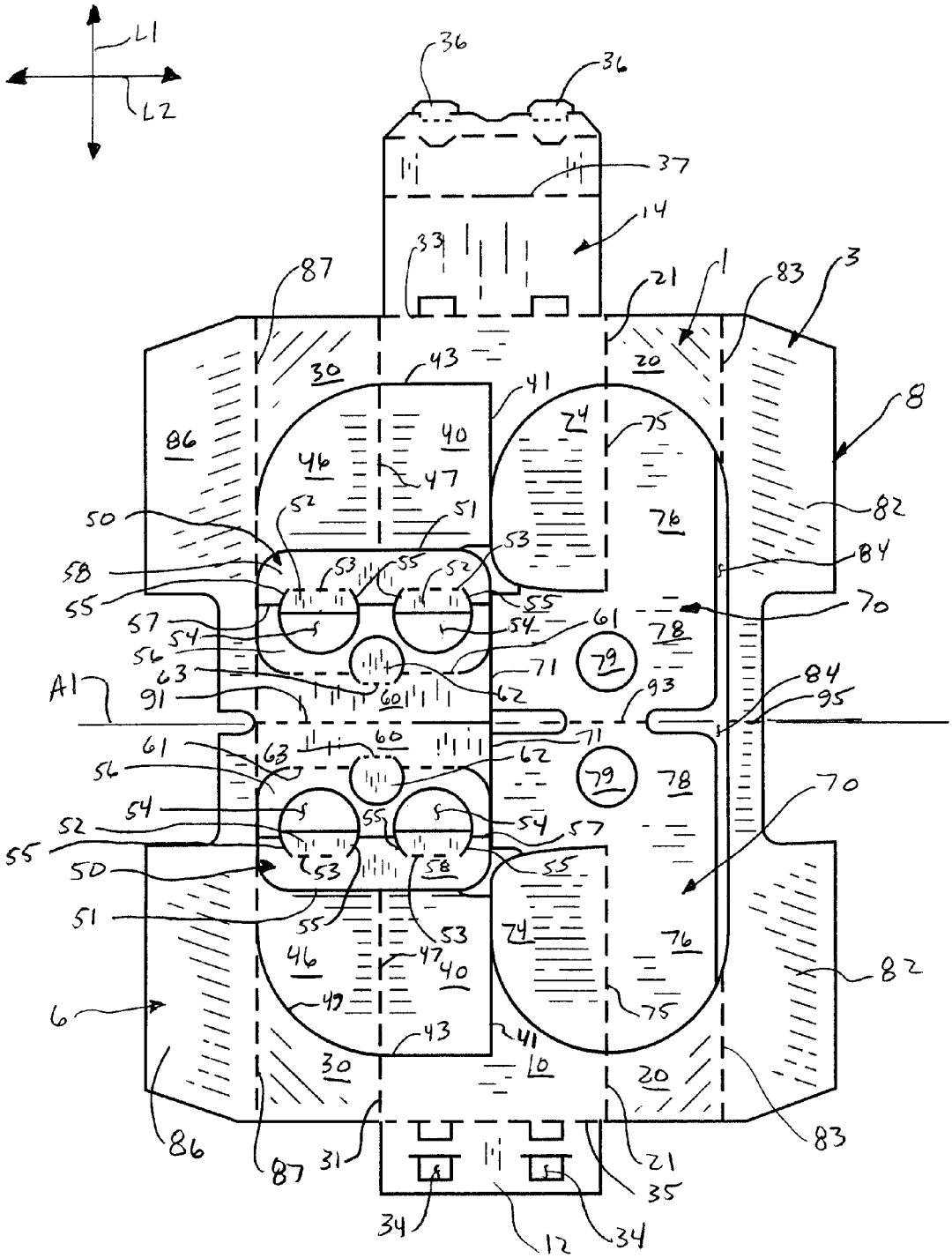
FIG. 1 is a plan view of a blank used to form a carrier according to one embodiment of the invention.
Figure 2:
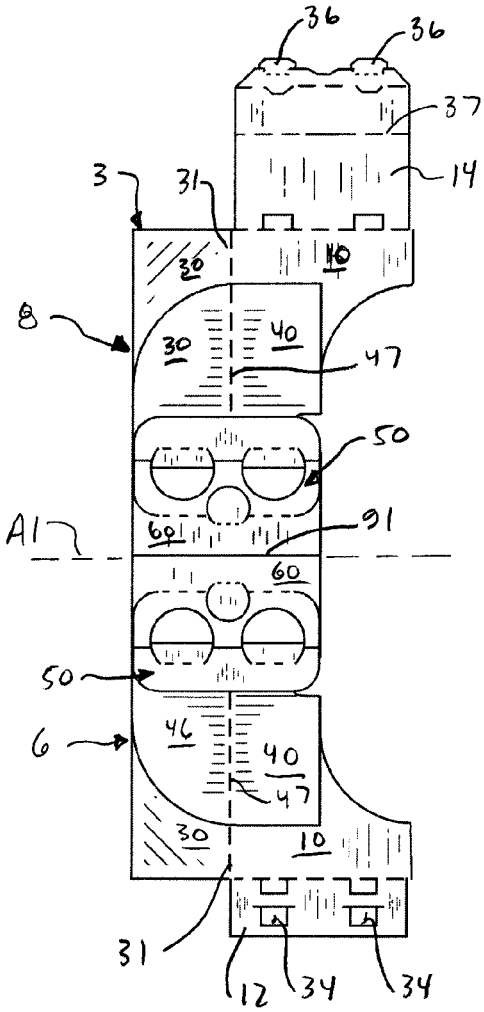
FIG. 2 is a plan view of one side of the blank of FIG. 1 partially assembled into the carrier.
Figure 3:
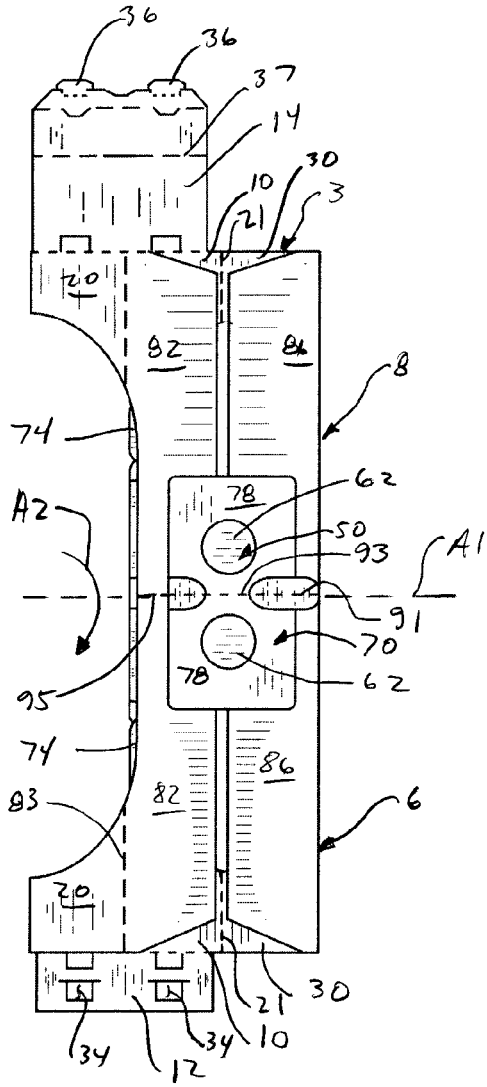
FIG. 3 is a plan view of an opposite side of the blank of FIG. 2.
Figure 7:
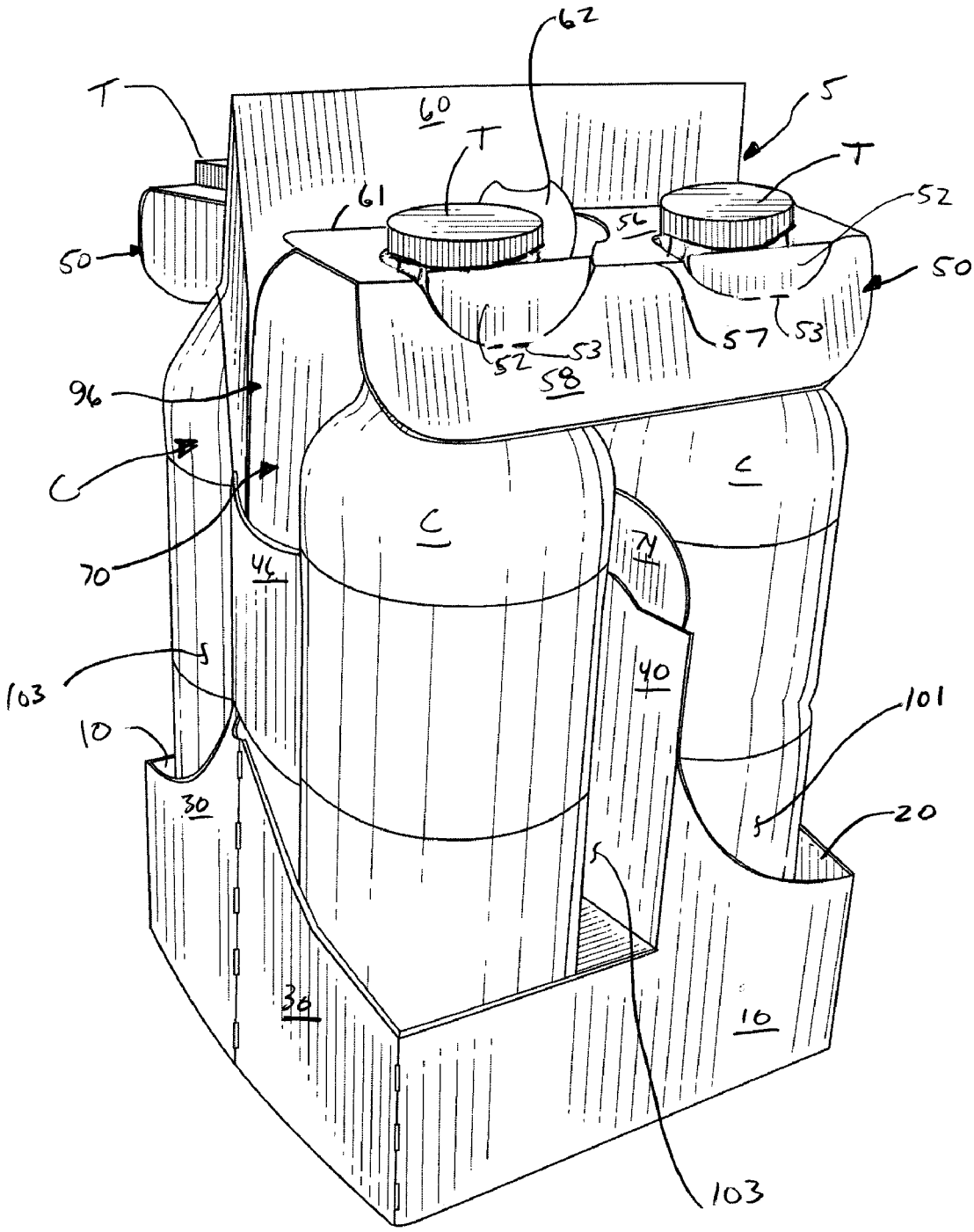
FIG. 7 is a perspective of the carrier with containers held therein.

FIG. 1 is a plan view of an exterior side 1 of a blank 3 used to form a package or basket-style carrier 5, in accordance with an exemplary embodiment of the present invention. As shown in FIG. 7, the carrier 5 is sized to contain four containers C. In the illustrated embodiment, the containers C are generally cylindrical beverage containers having a cap or lid T attached to an open top of the container. The carrier 5 may be sized and shaped to hold more or less than four containers C. Also, the carrier 5 may hold containers other than the generally cylindrical beverage containers C illustrated in FIG. 7.

The blank 3 has a longitudinal axis L1 and a lateral axis L2. The blank 3 has a front portion 6, a back portion 8, a first bottom panel 12 foldably connected to the front portion, and a second bottom panel 14 foldably connected to the back portion. In the illustrated embodiment, the front portion 6 and back portion 8 are in a generally mirror-image relationship about an axis of symmetry A1 passing through the longitudinal center of the blank 3. As discussed in more detail below, the blank 3 is formed into the carton 5 by folding the blank about the axis A1 so that the first portion 6 and the second portion 8 are overlapped and the first and second bottom panels 12, 14 are interlocked to form a bottom of the carton.

The front portion 6, comprises a front panel 10 foldably connected to a first front side panel 20 at a longitudinal fold line 21. The front panel 10 is foldably connected to a second front side panel 30 at a longitudinal fold line 31. The first bottom panel 12 is foldably connected to the front panel 10 of the front portion 6 at a lateral fold line 35. The first bottom panel 12 has two rectangular apertures 34 sized for receiving a corresponding male locking tab 36 of the second bottom panel 14. The second bottom panel 14 is foldably connected to the front panel 10 of the back portion 8 at a lateral fold line 33. The second bottom panel 14 includes a lateral fold line 37 to facilitate positioning of the locking tabs 36. Alternatively, the first bottom panel 12 and second bottom panel 14 could have other locking features, or the apertures 34 and locking tabs 36 could be otherwise sized and shaped. Also, the blank 3 could have a single bottom panel without departing from the invention.

A divider flap 40 is foldably connected to the front panel 10 at a longitudinal fold line 41. A lateral edge of the divider flap 40 is separated from the front panel at a lateral cut line 43. A central panel 46 is foldably connected to the divider flap 40 at a longitudinal fold line 47. A curved edge of the central panel 46 is separated from the second front side panel 30 at a curved cut line 49. As will be discussed below, the front panel 10 is positionable relative to central panel 46 by folding the divider flap 40 about fold line 47.

In the illustrated embodiment, a retention panel 50 is longitudinally adjacent the divider panel 40 and central panel 46. The retention panel 50 is foldably attached to a handle panel 60 at a lateral fold line 61. The retention panel 50 is separated from the divider panel 40 and central panel 46 by a lateral cut line 51. The retention panel 50 includes retaining tabs 52 respectively partially defined by curved tear lines 55 and respectively foldably attached to the retention panel at a lateral fold line 53 between the curved tear lines. The retention panel 50 includes two apertures 54 each respectively adjacent one of the retaining tabs 52. The retention panel 50 includes a first foldable portion 56 adjacent the handle panel 50 and a second foldable portion 58 foldably connected to the first foldable portion at a lateral fold line 57.

The handle panel 60 includes a finger flap 62 foldably connected to the handle panel at a lateral fold line 63. The finger flap 62 is separated from the handle panel 60 and the first portion 56 of the retention panel 50 by a curved cut line 65. The blank 3 could include handle features other than the finger flap 62 or the handle features could be omitted from the blank without departing from the invention.

In the illustrated embodiment, the first portion 6 of the blank 3 includes a reinforcement panel 70 foldably attached to the handle panel 60 at a longitudinal fold line 71. The reinforcement panel 70 includes a divider flap portion 74 foldably attached to a central panel portion 76 at a longitudinal fold line 75. The reinforcement panel 70 includes a handle portion 78 longitudinally adjacent the divider flap portion 74 and central panel portion 76. The handle portion 78 has a circular aperture 79 that is sized to receive the finger panel 62 in the assembled carrier 5.

As shown in FIG. 1, the front portion 6 includes a first reinforcement flap 82 foldably attached to the first side panel 20 at a longitudinal fold line 83. The first reinforcement flap 82 is separated from the reinforcement panel 70 by an opening 84 so that the reinforcement flap is free from foldable connection to the reinforcement panel. A second reinforcement flap 86 is foldably connected to the second side panel 30 at a longitudinal fold line 87 and is foldably connected to the handle panel 60 at a longitudinal fold line 89.

In the illustrated embodiment, the back portion 8 of the blank 3 has identical features (e.g., panels, flaps, fold lines, apertures, components, etc.) as the front portion 6 that are arranged in a mirror-image relationship relative to the central axis A1. Accordingly, like reference numbers have been used to indicate the identical components of the front portion 6 and back portion 8 of the blank 3. In the illustrated embodiment, the front portion 6 and the back portion 8 are foldably connected at a lateral fold line 91 connecting the two handle panels 60, a lateral fold line 93 connecting the two reinforcement panels 70, and a lateral fold line 95 connecting the two first reinforcement flaps 82.

With reference to FIGS. 2-5, in one exemplary method of erection, the carrier 5 may be erected from the blank 3 by respectively folding the reinforcement panels 70 about fold lines 71 so that the reinforcement panels are in face-to-face relationship with the handle panels 60, reinforcement panels 50, divider panels 40, and central panels 46. In this partially assembled position, the divider flap portions 74 of the reinforcement panels 70 respectively overlap and may be adhered to the divider flaps 40. The central panel portions 76 respectively overlap and may be adhered to the central panels 46. The handle panel portions 78 respectively overlap and may be adhered to the handle panels 60. In the illustrated embodiment, the handle panel portions 78 at least partially overlap the reinforcement panels 50, but are not adhered to the reinforcement panels to allow the reinforcement panels 50 to be positioned relative to the handle panel portions of the reinforcement panels 70. Next, the first side panels 20 are folded about longitudinal fold lines 21, so the first side panels are in face-to-face relationship with the interior surface of the front panels 10 and the first reinforcement flaps 82 overlap the divider flap portions 74 of the reinforcement panels 70. Also, the first reinforcement flaps 82 at least partially overlap a portion of the interior surface of the front panels 10, and a portion of the handle panel portions 78 of the reinforcement panels. Next, the second reinforcement panels 86 are folded about longitudinal fold lines 87 to overlap the central panel portions 76 of the reinforcement panels 70, at least a portion of the interior surface of the front panels 20, and a portion of the handle panel portions 78 of the reinforcement panels. In one exemplary embodiment, the first reinforcement flaps 82 are adhered to the handle panel portions 78 of the reinforcement panels 70. The second reinforcement flaps 86 can be adhered to the central panel portions 76 and the handle panel portions 78 of the reinforcement panels 70. At this stage in the assembly process, the exterior and interior sides of the partially assembled blank 3 are respectively illustrated in FIGS. 2 and 3.

Figure 4B:
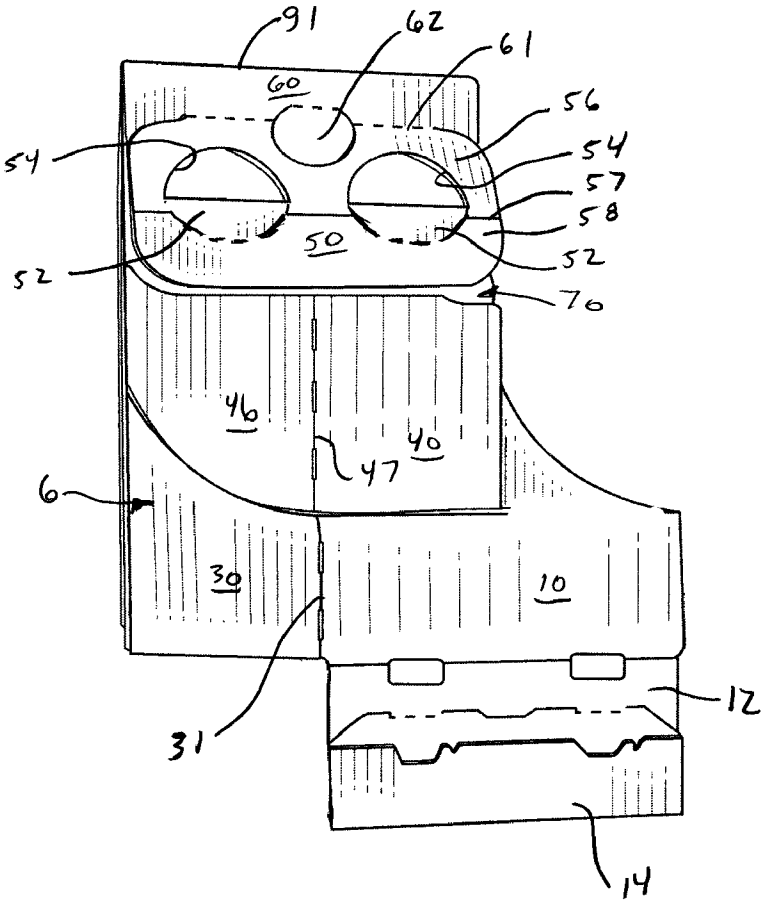
FIG. 4B is a plan view of an opposite side of the blank of FIG. 4A, with the blank further partially assembled
Figure 4A:
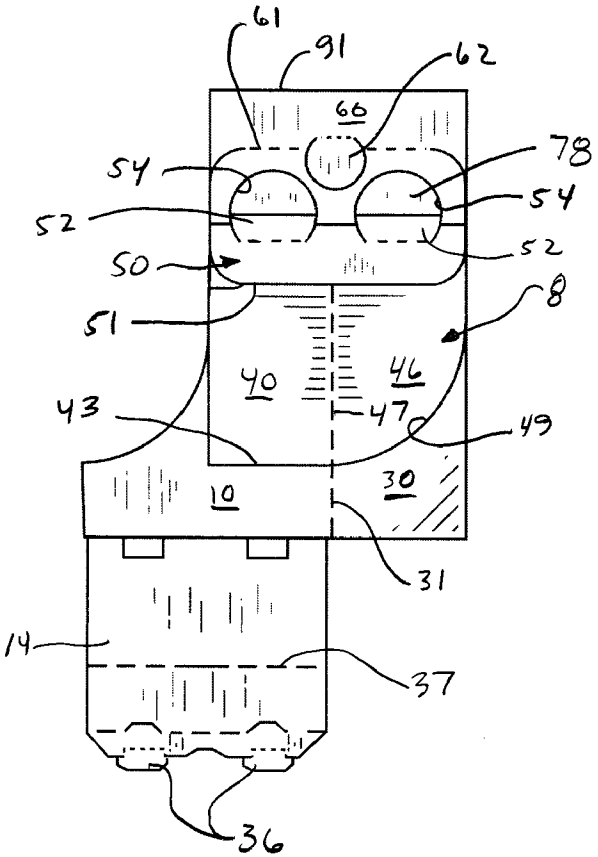
FIG. 4A is a plan of one side of the blank further partially assembled.
Figure 5:
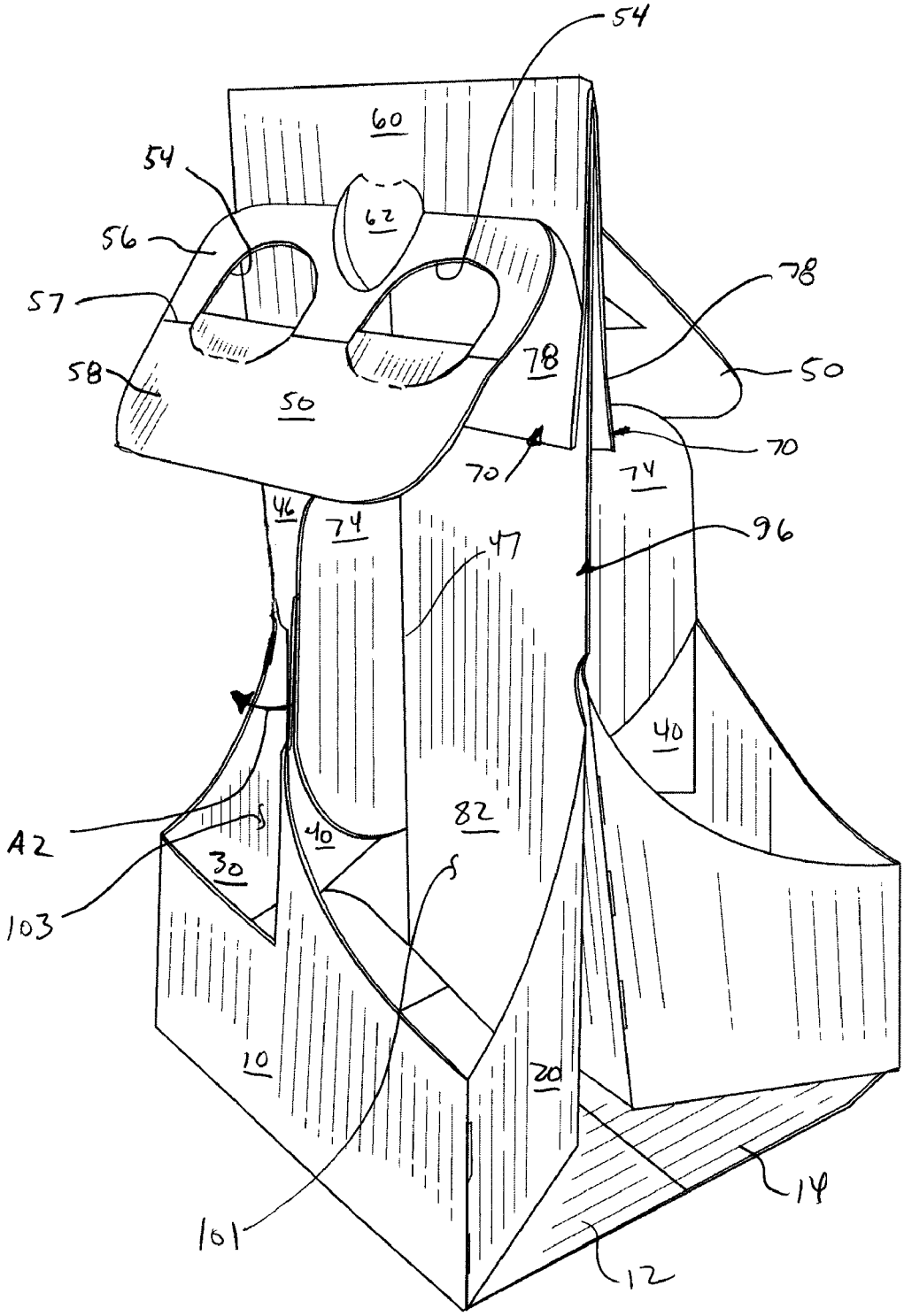
FIG. 5 is a perspective of the blank further partially assembled.
Figure 6:
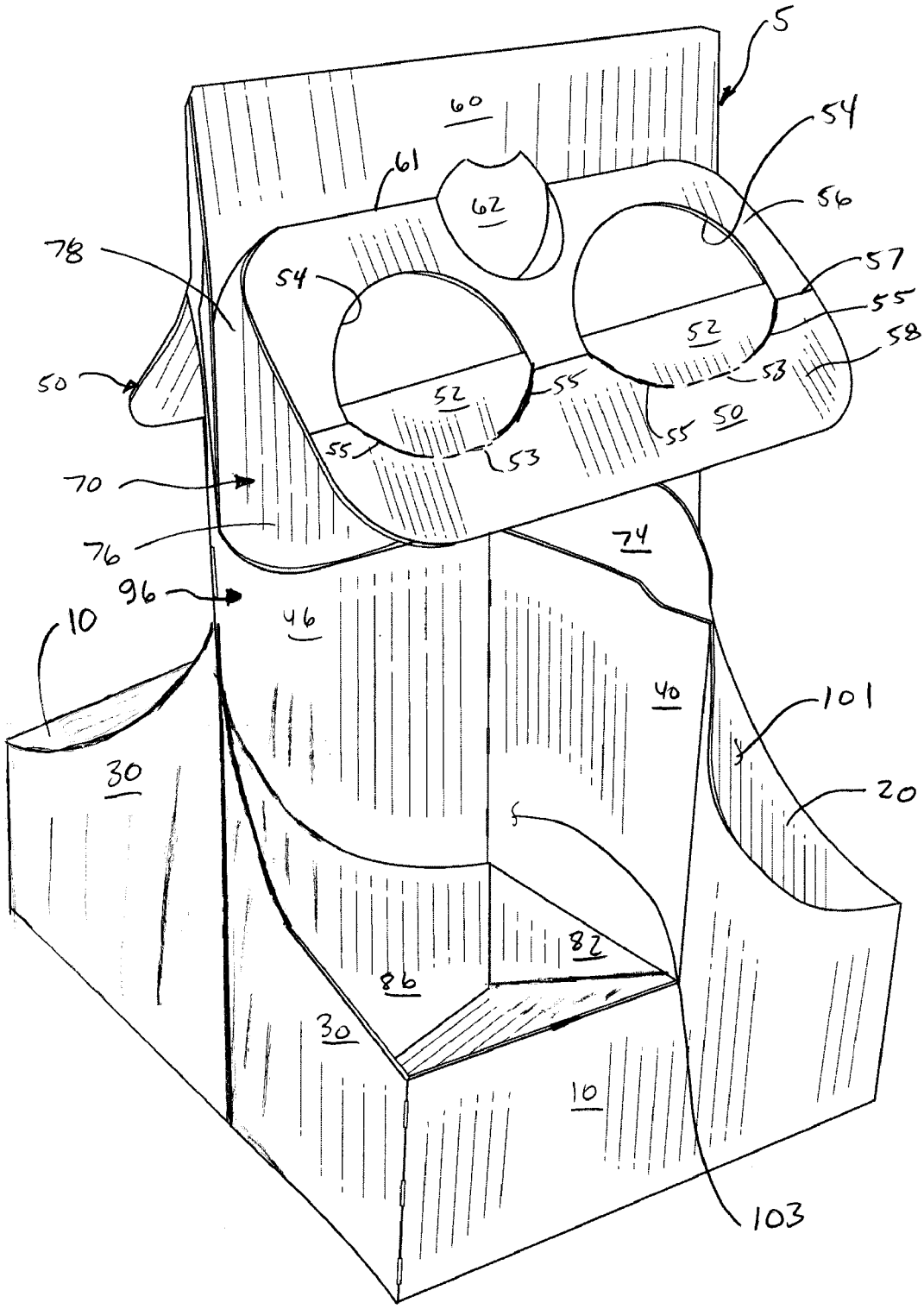
FIG. 6 is a perspective of the carrier.

Next, the blank 3 is further partially assembled into the carrier 5 by folding the back portion 8 of the blank about axis A1 so that the back portion overlaps the front portion 6 as shown in FIG. 4A. As shown in FIG. 4B, the first and second bottom panels 12, 14 are positioned in interlocking engagement by folding the second bottom panel about fold line 37 and inserting the locking elements 36 of the second bottom panel into the locking recesses 34 of the first bottom panel. Alternatively, the first and second bottom panels 12, 14 can remain free from interlocking engagement until later in the assembly and loading process to allow the containers C to be loaded through an open bottom of the carrier 5. As shown in FIG. 5, the divider flap 40, with the divider flap portion 74 of the reinforcement panel 70 adhere thereto, forms a moveable flap that is folded about fold line 47 to form two container-receiving spaces 101, 103 by positioning the front panel 10 in a spaced-apart relationship from the reinforcement flap 82 and central panel 46. When the divider flap 40/divider flap portion 74 is folded about the fold line 47, the retention panel 50 is upwardly folded about fold line 61 because of contact with an upper edge of the divider flap portion with the retention panel. In the illustrated embodiment, the reinforcement flap 82, the central panel 46, and the handle panel 60 at least partially define a back wall 96 or panel of the carrier 5. The retention panel 50 is pivotable relative to the back wall 96 (e.g., handle panel 60) at fold line 61 so that the retention panel can be raised as shown in FIGS. 5 and 6 to accommodate containers C in the carrier 5. As shown in FIG. 6, the front panel 10 is in generally parallel planar relationship with the central panel 46 and is spaced apart from the central panel by the second side panel 30 and the divider flap 40/divider flap portion 74 combination. The front panel is in generally parallel planar relationship with the reinforcement flap 82 and is spaced apart from the reinforcement flap by the first side panel 20 and the divider flap 40/divider flap portion 74 combination.

In the illustrated embodiment the reinforcement flap 82 at least partially comprises a portion of the back wall 96 of the carrier 5 that at least partially defines the back of the first container-receiving space 101. The side panel 20 at least partially defines one side of the first container-receiving space 101. The moveable divider panel 40/divider portion 74 combination at least partially defines another side of the first container-receiving space 101. The front panel 10 at least partially defines the front of the first container-receiving space 101. The front, back, and sides of the second container-receiving space 103 are similarly at least partially respectively defined by the front panel 10, central panel 46, side panel 30, and the moveable divider flap 40/divider flap 74 combination. In the illustrated embodiment, the front portion 6 and back portion 8 of the blank 3 each respectively form first and second container-receiving openings 101, 103 of the carrier 5, but the carrier may have more or less than four container-receiving openings without departing from the invention.

As shown in FIG. 7, the containers C may be inserted into the carrier 5 by placing the containers in the container-receiving openings 101, 103. Alternatively, the containers C may be inserted through an open bottom of the carrier 5 prior to interlocking the first and second bottom panels 12, 14. The bottoms of the containers C are supported by the bottom wall of the carrier 5 formed by the interlocking first and second bottom panels 12, 14. The retention panels 50 are upwardly folded about fold lines 61 so that tops of the containers are respectively inserted through the apertures 54 in the retention panels 50. The second portions 58 of the retention panels 50 are downwardly folded about fold line 57 so that the second portions and the retention tabs 52 are positioned generally perpendicular to the first portions 56 of the retention panels 50. The retention tabs 52 can engage an overhanging portion (e.g., flange, cap, lid, etc.) of the tops T of the containers C in a manner that seeks to maintain the containers in a fixed position in the carrier 5 when the loaded carrier is carried. The use of the divider panels 40 positioned between each of the first and second container-receiving openings 101, 103 also assist in preventing the containers C from moving during transport of the loaded carrier and prevent adjacent containers from contacting each other.

The carrier 5 may be carried by pushing the finger flaps 62 from either side of the carrier so that the finger flaps are pushed through to the other side of the carrier to allow the carrier to be grasped at the handle portions 60. Containers C can be dispensed from the carrier by folding the retention panel 50 upward to withdraw the tops T of the containers C from the apertures 54 so that the containers C can be removed from the container-receiving openings 101, 103.

The exemplary carrier embodiment discussed above accommodates four containers C arranged in two rows, but the present invention is not limited to these numbers. As one example, additional containers may be accommodated by increasing the size of the blank 3 (e.g., in the lateral direction L2 in FIG. 1) and forming additional container-receiving spaces therein. Also, the blank 3 could have less than four container-receiving spaces by having only a single portion of the blank instead of a front portion 6 and a back portion 8.

In the illustrated embodiment, the carrier 5 is shown as accommodating containers C having a generally round upper rim, cap, or top portion T and as having an exterior contour defined by generally circular horizontal cross-sections. Other types, sizes, and shapes of containers, however, can be accommodated by a carrier according to principles of the present invention.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carrier for holding a plurality of containers, the carrier comprising:

panels that extend at least partially around an interior of the carrier, the panels comprise at least one bottom panel, a front panel, a back panel, a handle panel, and at least two side panels;

a divider flap foldably attached to the back panel and the front panel for positioning of the front panel and side panels relative to the back panel when the divider flap is folded out of a planar relationship with the back panel, the side panels, the back panel, the divider flap, and the front panel being arranged to at least partially define at least two container-receiving spaces of the interior;

a retention panel pivotable relative to the back panel for retaining at least one container of the plurality of containers, the retention panel being foldably attached to the handle panel, the divider flap being positioned for contacting the retention panel so as to initiate upward folding of the retention panel as the divider panel is moved out of plane with the back panel; and a reinforcement panel foldably attached to the handle panel and providing a supplemental layer of material attached to the divider flap so that the divider flap includes the supplemental layer of material.

2. The carrier of claim 1 wherein the divider flap is perpendicular to the back panel and the front panel.

3. The carrier of claim 2 wherein the divider flap is parallel to the side panels.

4. The carrier of claim 1 wherein the retention panel has at least two apertures for respectively receiving a portion of a container to retain the container in the carrier.

5. The carrier of claim 4 wherein the retention panel comprises at least two retaining tabs, each retaining tab being adjacent one of the apertures for respectively contacting a top portion of one of the containers.

6. The carrier of claim 1 wherein the retention panel is a first retention panel and the carrier further comprises a second retention panel foldably attached to the handle panel.

7. The carrier of claim 6 wherein the first retention panel has apertures for respectively receiving and aiding in retaining containers in a first and a second container-receiving space and the second retention panel has apertures for respectively receiving and aiding in retaining containers in a third and a fourth container-receiving opening.

8. The carrier of claim 1 wherein the supplemental layer of material attached to the divider flap is a divider flap portion of the reinforcement panel.

9. The carrier of claim 1 wherein the back panel comprises a central panel foldably attached to the divider flap and the reinforcement panel has a central panel portion attached to the central panel for providing a supplemental layer of material attached to the central panel.

10. The carrier of claim 9 wherein the reinforcement panel comprises a handle portion attached to the handle panel for providing a supplemental layer of material attached to the handle panel.

11. The carrier of claim 10 further comprising a first reinforcement flap and a second reinforcement flap, the first reinforcement flap being foldably attached to one of the side panels, and the second reinforcement flap being foldably attached to the other of the side panels, the central panel, and the handle panel.

12. The carrier of claim 11 wherein the first reinforcement flap provides a supplemental layer of material attached to the central panel.

13. The carrier of claim 11 wherein the first and the second reinforcement flap provides a supplemental layer of material attached to the handle panel.

14. The carrier of claim 1 wherein the divider flap has an upper edge, the upper edge being for contact with the retention panel when the retention panel is upwardly folded.

15. A blank for forming a carrier for holding a plurality of containers, the blank comprising:

panels that comprise at least one bottom panel, a front panel, a back panel, at least two side panels, a handle panel, and a retention panel foldably attached to the handle panel;

a divider flap foldably attached to the back panel and the front panel, the divider flap being foldably attached to the back panel at a longitudinal fold line, and being positionable relative to the fold line to position the front panel and side panels relative to the back panel when the divider flap is folded out of a planar relationship with the back panel, the retention panel having at least two apertures, the divider flap being positioned for contacting the retention panel so as to initiate upward folding of the retention panel when the blank is formed into the carrier; and a reinforcement panel foldably attached to the handle panel, the reinforcement panel having a divider flap portion for providing a supplemental layer of material attached to the divider flap when the blank is formed into the carrier.

16. The blank of claim 15 wherein the at least two apertures are for respectively receiving a portion of a container of the plurality of the containers held in the carrier formed from the blank.

17. The blank of claim 15 wherein the retention panel comprises at least two retaining tabs, each retaining tab being adjacent one of the apertures.

18. The blank of claim 15 wherein the divider flap is a first divider flap, the front panel is a first front panel, and the retention panel is a first retention panel, and the blank further comprises a second divider flap, a second front panel, and a second retention panel, the second divider flap being foldably attached to the back panel and the second front panel and the second retention panel being foldably connected to the handle panel.

19. The blank of claim 18 wherein the first and second retention panels have apertures for respectively receiving a container in the carrier formed from the blank.

20. The blank of claim 15 wherein the back panel comprises a central panel foldably attached to the divider flap and the reinforcement panel has a central panel portion for providing a supplemental layer of material attached to the central panel and a handle panel portion for providing a supplemental layer of material attached to the handle panel.

21. The blank of claim 20 further comprising a first reinforcement flap and a second reinforcement flap, the first reinforcement flap being foldably attached to one of the side panels, the second reinforcement flap being foldably attached to the other of the side panels, the central panel, and the handle panel.

22. The blank of claim 15 wherein the divider flap has an upper edge being for contact with the retention panel when the blank is formed into the carrier.

23. A method of forming a carrier for containing a plurality of containers, the method comprising:

providing a blank having panels that comprise a front panel, a back panel, at least two side panels, a handle panel, and a retention panel foldably connected to the handle panel, and a divider flap foldably attached to the back panel and the front panel, the retention panel has at least one aperture for respectively receiving a portion of a container of the plurality of the containers; and pivoting the divider flap out of a planar relationship with the back panel to at least partially define at least two container-receiving openings by positioning the front panel and side panels relative to the back panel, the pivoting the divider flap comprises contacting the divider flap with the retention panel so as to initiate pivoting the retention panel upward relative to the handle panel.

24. The method of claim 23 wherein the blank comprises at least one bottom flap and the method further comprises positioning the at least one bottom flap to at least partially close the bottom of the carrier.

25. The method of claim 23 wherein pivoting the divider flap positions the front panel at a location spaced apart from the back panel.

26. The method of claim 25 wherein pivoting the divider flap positions the first side panel at a location spaced apart from the second side panel.

27. The method of claim 26 wherein the divider flap is pivoted to a position extending between the back panel and the front panel wherein the divider flap is generally parallel to the side panels.

28. The method of claim 23 wherein the blank further comprises a reinforcement panel foldably attached to the handle panel, the method further comprising folding the reinforcement panel to at least partially overlap the handle panel, back panel, and divider flap.

29. The method of claim 28 wherein the blank further comprises a first reinforcement flap foldably attached to at least one of the panels and a second reinforcement flap foldably attached to at least one of the panels, the method further comprises folding the first reinforcement flap to at least partially overlap the reinforcement panel and folding the second reinforcement flap to at least partially overlap the reinforcement panel.

30. The method of claim 29 wherein the first reinforcement flap is foldably attached to one of the side panels, and the second reinforcement flap is foldably attached to the other of the side panels, the central panel, and the handle panel.

31. The method of claim 23 wherein the pivoting the divider flap comprises applying a force to the divider flap to initiate formation of the at least two container receiving openings.

32. The method of claim 31 wherein the applying a force to the divider flap causes the positioning of the front panel and the side panels relative to the back panel without application of force to the front or side panels.

* * * * *